United States Patent [19]

Kato

[11] Patent Number: 5,010,219

[45] Date of Patent: Apr. 23, 1991

[54] PUSH BUTTON SWITCH WITH ACTUATOR FOR APPLYING TRANSVERSE FORCE TO BUCKLING SPRING

[75] Inventor: Takafumi Kato, Iwaki, Japan

[73] Assignee: Alps Electric Co., Ltd., Tokyo, Japan

[21] Appl. No.: 376,712

[22] Filed: Jul. 7, 1989

[30] Foreign Application Priority Data

Jul. 11, 1988 [JP] Japan ..... 63-90944[U]

[51] Int. Cl.[5] ..... H01H 13/30

[52] U.S. Cl. ..... 200/408; 200/457; 200/517; 200/521

[58] Field of Search ..... 200/408, 457, 458, 517, 200/521

[56] References Cited

U.S. PATENT DOCUMENTS 4,433,224 2/1984 Kitchen ..... 200/408 X
4,528,431 7/1985 Coleman, III ..... 200/408

FOREIGN PATENT DOCUMENTS 2582444 11/1986 France ..... 200/457
95604 10/1960 Netherlands ..... 200/457

*Primary Examiner*—Renee S. Luebke
*Attorney, Agent, or Firm*—Guy W. Shoup; Paul J. Winters

[57] ABSTRACT

A push button switch used for a personal computer or a word processor, which uses a membrane switch in a contact portion. The push button switch comprises a casing, a key top slidably guided along the casing, a contact portion arranged below the key top, an actuator rotatably supported on the casing to open and close the contact portion, a spring retained in a curved orientation between the actuator and the top key, and a click portion provided on the actuator by which a curved side of the spring is pressed, the click portion of the actuator actuated by downward movement of the key top urging the side of the spring so as to invert the curved orientation of the spring.

5 Claims, 4 Drawing Sheets

PUSH BUTTON SWITCH WITH ACTUATOR FOR APPLYING TRANSVERSE FORCE TO BUCKLING SPRING

BACKGROUND OF THE INVENTION

1. Field of the Invention

The present invention relates to a push button switch used for a personal computer, a word processor and the like, and more particularly to a push button switch which uses a membrane switch in a contact portion and has a click feeling.

2. Description of the Prior Art

A prior art push button switch of this kind is as shown in FIGS. 6 (*a*) and (*b*), which are respectively sectional views showing the state before and after the depression of a key top of a conventional push button switch.

In these Figures, a key indicated at 1 is mounted slidably along a hollow cylindrical supporting body 3 which is stood upright on a frame 2. The frame 2 has one cylindrical supporting body 3 per to one key 1 on a keyboard. The frame 2 is mounted on a base plate 4.

The key 1 has a downwardly extending mandrel 5. The mandrel 5 is located on the inside of the cylindrical supporting body 3 of the frame 2, whereby the key 1 is within the cylindrical supporting body 3, and whereby the the key 1 is slidably moved within the cylindrical supporting body 3. In the outer surface of the mandrel 5 having two bifurcated and separated skirt portions 6 (only one of which is shown) and in the inner surface of the cylindrical supporting body 3, a rib and a slot are provided so that during the movement of the key 1 in a vertical direction, the rib and slot cooperate to direct and guide the movement of the key 1.

A spring 7 is compressed between the key 1 and the actuator 8. When the key 1 is depressed, the actuator 8 of a pivotal type closes a contact switch 10 of a membrane contact switch construction 9. An upper end of the spring 7 acts on a mounting bed 11 which is present in the mandrel 5 of the key 1. The mounting bed 11 is slightly inclined so that the spring 7 is bent in a first selected direction (rightward in FIG. 6 (*a*)) when the key is not pressed. Buckling of the spring 7 in a lateral direction is restricted by the skirt portion 6 of the mandrel 5.

Since the actuator 8 is always at rest on the upper surface 12 of the membrane contact switch construction 9, the spring 7 always provides an upward bias the key 1. The upward movement of the key 1 is restricted by stop portions 13 (only one of which is shown). The stop portions 13 are adjacent to each skirt portion 6 of the mandrel 5 are affixed to the outer surface of the skirt portions 6, and are in engagement with shoulders 14 (only one of which is shown) on the inner surface of the cylindrical supporting body 3. Each of the stop portions 13 has an inclined surface. The inclined surface of the stop portion 13 is paired with the inclined surface of the shoulder 14 so that in the case where in assembling the keyboard or in replacing the key 1, the key 1 can be inserted into the cylindrical supporting body 3 and each stop portion 13 will be obstructed by the shoulder 14.

In the state wherein the key 1 is not depressed and is pushed up to the uppermost end by the spring 7, the actuator 8 is at rest as shown in FIG. 6 (*a*). In this state, surfaces in contact with the upper surface of the membrane contact switch construction 9 are only a bottom surface 16 of a supporting bed 15 of the actuator 8 and a bottom surface 18 of a supporting bed 17. The bottom surface 16 of the supporting bed 15 and the bottom surface 18 of the supporting bed 17 are sufficiently distant from a contact switch 10, when the actuator 8 is at rest. Thus, even though the spring 7 is compressed, no force is applied to the contact switch 19. When the actuator 8 is at rest, there is a slight clearance between a bottom surface 21 of a projection 20 and the upper surface 12 of the membrane contact switch construction 9.

The membrane contact switch construction 9 has an upper layer 22, an intermediate layer 23 and a lower layer 24. The upper layer 22 has a bottom surface 25 formed with circular contacts 26 (only one of which is shown). The lower layer 24 has an upper surface 27 formed with a circular contact 28 (only one of which is shown). The intermediate layer 23 is formed with a circular opening 29. These circular contacts 26 and 28 constitute a contact switch 10. Accordingly, when the upper layer 22 is moved into the circular opening 29 of the intermediate layer 23, the circular contact 26 and the circular contact 28 contact to close the contact switch 19, as shown in FIG. 6 (*b*).

When the key 1 is depressed from the FIG. 6 (*a*) position to the FIG. 6 (*b*) position, force F transmitted by the spring 7 to the actuator 8 is increased by the force applied to the key 1. When the force F becomes greater than the force when the actuator 8 is at rest, moment M becomes larger than a moment formed by a product of the force F and a distance x. The moment M is produced when the spring 7 is excessively buckled from the FIG. 6 (*a*) position to the FIG. 6 (*b*) position to increase the buckling amount thereof. The actuator 8 is rotated about an initial pivot, that is, about fore ends 30 and 31 of the bottom surface of the supporting bed. By this clockwise rotation, the bottom surface 21 of the projection 20 comes into contact with the upper surface 12 of the membrane contact switch construction 9. This forces the upper layer 22 of the membrane contact switch construction 9 to move into the circular opening 29 of the intermediate layer 23. Accordingly, the circular contact 26 of the bottom 25 of the upper layer 22 comes into contact with the circular contact 28 of the upper surface of the lower layer 24.

When the actuator 8 is rotated about the initial pivot, the bottom surface 21 of the projection 20 of the actuator 8 comes into contact with a point 32 of the upper layer 22 of the membrane contact switch construction 9.

When the contact switch 10 is closed, an user feels this by the excessive buckling (FIG. 6 (*b*)) of the spring 7, and thus releases his finger from the key 1.

In the aforementioned prior art, the spring 7 provided between the key 1 and the actuator 8 is buckled by the downward movement of the key 1 to obtain a click feeling. Since the buckling of the spring 7 is due solely to longitudinal forces on the ends of the spring, the timing of the buckling can vary as properties of the spring vary within manufacturing tolerances. This variation in timing can result in unstable switching and unstable tactile feedback for an operator. Further, there is a limit as to how short the spring can be for a given set of parameters if buckling is to be produced by longitudinal forces applied to the spring. This problem limits the compactness of the switch.

SUMMARY OF THE INVENTION

For achieving the aforesaid object, the invention provides a push button switch comprising a casing, a key top slidably insertable into said casing, a contact portion arranged below said key top, an actuator rotatably supported on said casing to open and close said contact portion by pressing said contact portion, a spring retained with curving in a first orientation between said actuator and said top key, characterized in that a click portion is provided on said actuator by which a transverse force is applied to an outside portion of said spring at or near a midpoint of said spring when said click portion of said actuator is actuated by downward movement of said key top so as to invert the first curved orientation of said spring.

BRIEF DESCRIPTION OF THE DRAWINGS

FIGS. 1 to 5 illustrate one embodiment of the present invention, in which FIG. 1 is a sectional view showing the state before a key top of a push button switch according to the present invention is depressed;

FIG. 2 is a sectional view showing the state of the halfway depression of the key top of the push button switch;

FIG. 3 is a sectional view showing the state after the key top of the push button switch is depressed;

FIG. 4 is a sectional view taken on line A—A of FIG. 1 and

FIG. 5 is a perspective view of an actuator; and

DETAILED DESCRIPTION OF THE PREFERRED EMBODIMENTS

One embodiment of the present invention will be described hereinafter with reference to FIGS. 1 to 5.

Figure 2:
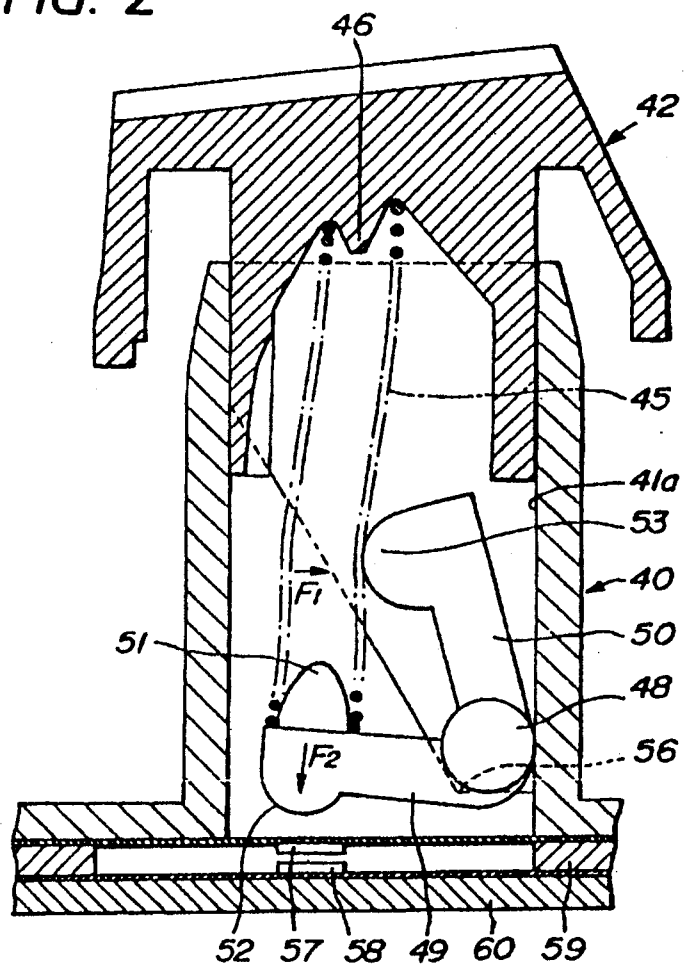
Figure 1:
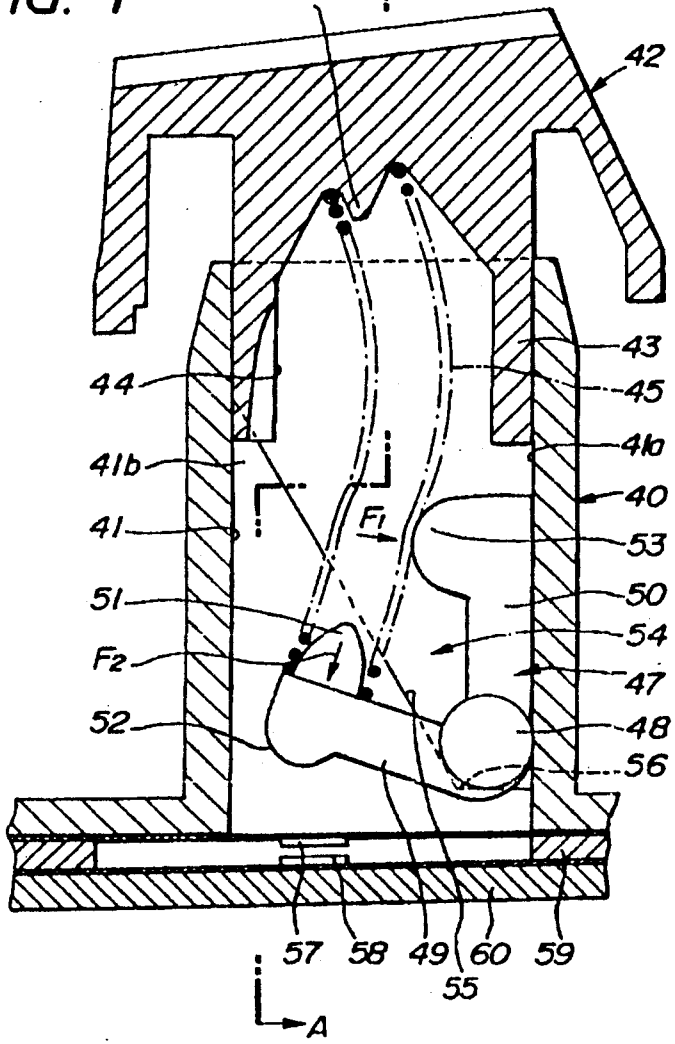
Figure 4:
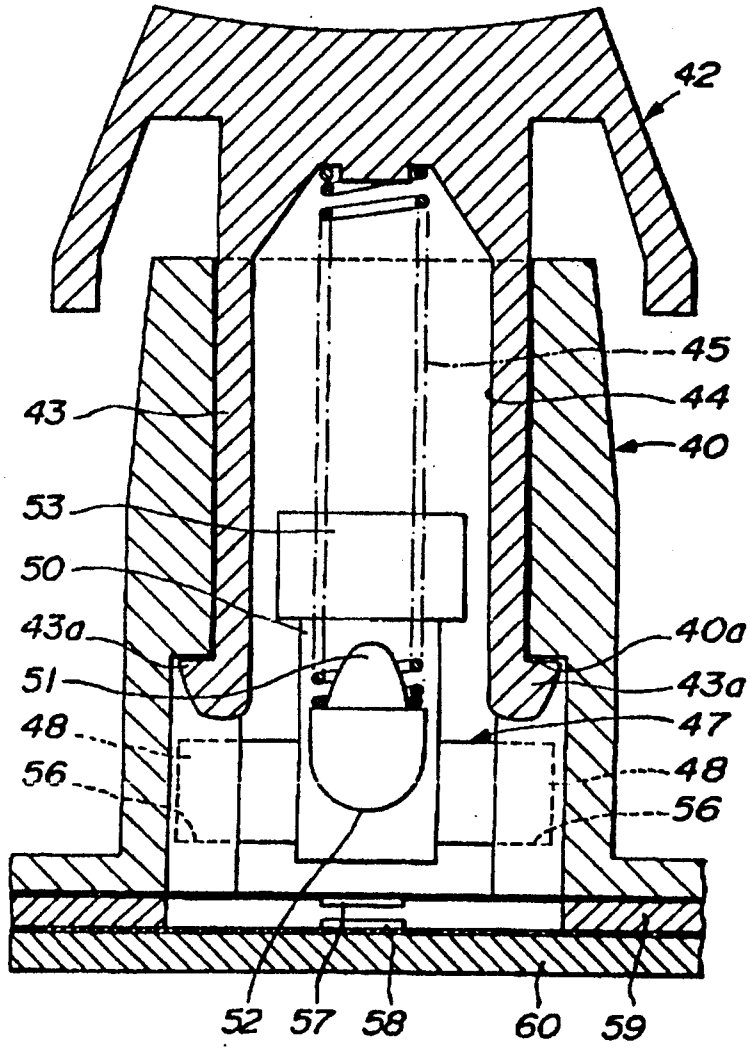
Figure 3:
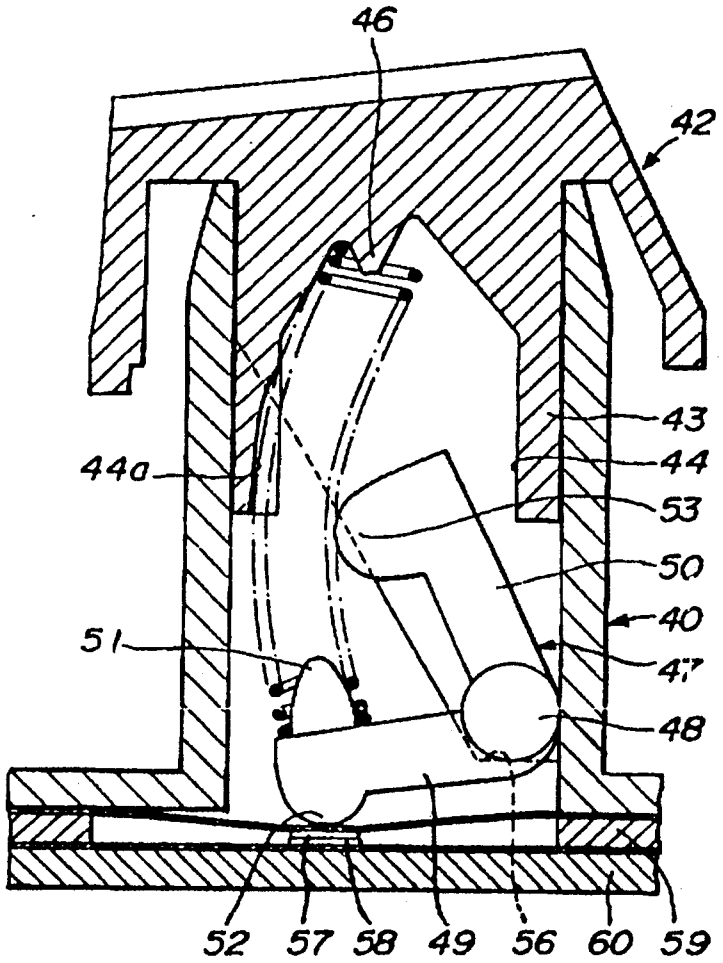
Figure 5:
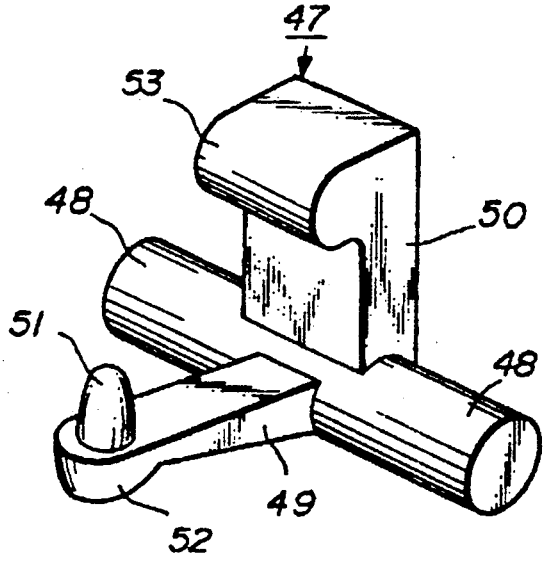
Figure 6B:
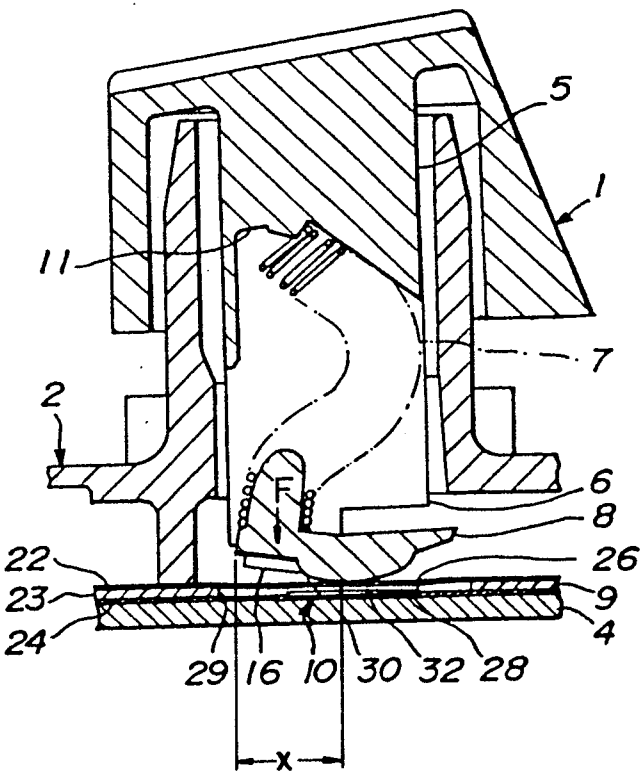
FIG. 6(b) PRIOR ART
FIGS. 6(*a*) and (*b*) are respectively sectional views before and after the key top of a conventional push button switch is depressed.
Figure 6A:
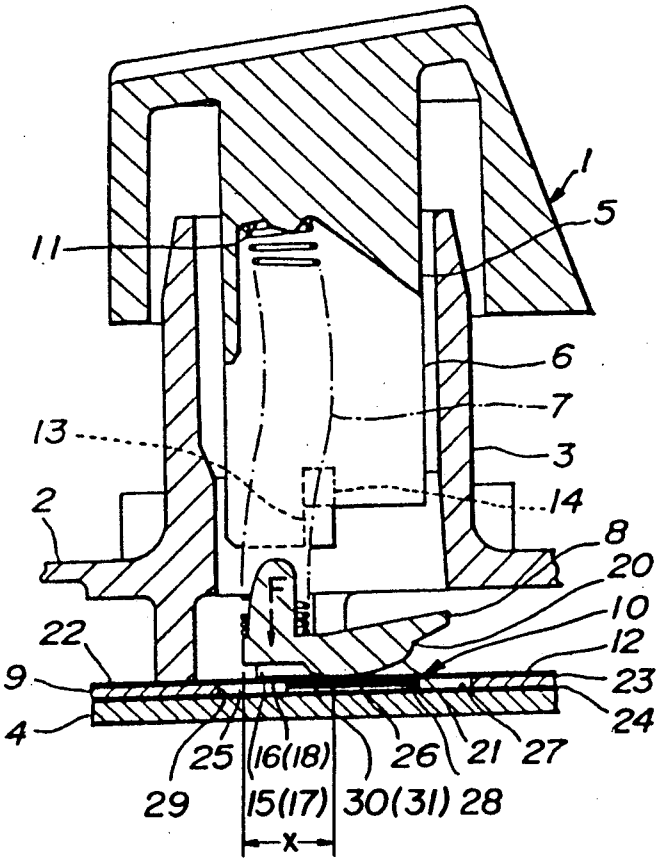
FIG. 6(a) PRIOR ART

FIG. 1 is a sectional view showing the state before the key top of a push button switch according to the present invention is depressed, FIG. 2 is a sectional view showing the state of halfway depression of the key top of the push button switch, FIG. 3 is a sectional view showing the state after the key top of the push button switch is depressed, FIG. 4 is a sectional view taken on line A—A of FIG. 1, and FIG. 5 is a perspective view of an actuator.

In these Figures, a casing indicated at 40 is formed with a hole 41, into which a key top 42 is received movably up and down. The key top 42 is integrally formed at the lower part thereof with a sliding portion 43, which is slidably moved within the hole 41. The sliding portion 43 is formed at the lower surface with a hole 44, into which one end of a coil spring 45 is inserted and secured to a small projection 46 within the hole 44. An actuator indicated at 47 has rotational shafts 48, 48 on opposite ends thereof as shown in FIG. 5, and a pair of extended portions 49, 50 provided in a direction intersecting at right angles to the rotational shafts 48. One extended portion 49 is provided on the upper surface side with a spring receiving projection 51 to which the other end of the coil spring 45 is fitted. The lower surface side of extended portion 49 is provided with an arcwise projection 52 for pressing an upper electrode which will be described later. The other extended portion 50 is arranged at an acute angle with respect to the extended portion 49 and is provided with a projection 53 as a click portion on which the side of the coil spring 45 is pressed. The rotational shafts 48, 48 of the actuator 47 are rotatably supported on a recessed stepped portion 54 formed in a side wall 41*b* of the hole 41 of the casing 40. The recessed stepped portion 54 has a bottom portion 55 formed obliquely as shown in FIG. 1, and one side wall 41*a* adjacent thereto is formed on a flat portion 56, the rotational shaft 48 being retained on the flat portion 56. The clockwise rotation of the actuator 47 is defined by the contact of the extended portion 50 with the side wall 41*a* of the hole 41. In this state, the spring receiving projection 51 of the extended portion 49 is set to be inclined in the direction of the projection 53 of the extended portion 50. Therefore, the coil spring 45 provided between the spring receiving projection 51 and the hole 44 of the key top 42 is curved toward the projection 53 of the extended portion 50. The projection 53 is pressed by the side of the coil spring 45. This pressing force is, in the FIG. 1 state, set to be greater than the force applied to the spring receiving projection 51 of the extended portion 49, and the actuator 47 is urged clockwise. The extended portion 50 is pressed against the side wall of the hole 41.

An upper electrode 57, a lower electrode 58 and a spacer 59 disposed between the upper and lower electrodes 57 and 58 constitute a well known membrane switch. Reference numeral 60 denotes a base plate for holding the membrane switch.

The operation of the thus constructed embodiment will be described below.

When not depressed as shown in FIG. 1, the coil spring 45 disposed between the key top 42 and the spring receiving projection 51 of the actuator 47 is curved rightward, and the side of the curved coil spring 45 is pressed against the projection 53 of the actuator 47. Since this pressing force $F_1$ is set to be greater than a force $F_2$ applied by the coil spring 45 to the spring receiving projection 51, the actuator 47 as a whole is urged clockwise, and the extended portion 50 comes into contact with the side wall 41*a* of the hole 41 so that the extended portion 50 is stopped. The arcwise projection 52 of the lower surface of the extended portion 49 stays away from the upper electrode 57, and a contact portion composed of the upper and lower electrodes 57 and 58 is in an open state.

When the key top 42 is depressed by an applied force, it moves downward from the FIG. 1 state. The force is transmitted by the coil spring 45 to the spring receiving projection 51 of the actuator 47. This causes the actuator 47 to rotate about the rotational shaft 48 counterclockwise against the force $F_1$ applied by the side of the coil spring 45. When the actuator 47 rotates counterclockwise, the projection 53 urges the rightwardly curved coil spring 45 to an inverted neutral point as shown in FIG. 2. When the key top 42 is further moved downward so that the actuator 47 is rotated further counterclockwise, the coil spring 45 moves beyond the inverted neutral point and is inverted and curved left ward as shown in FIG. 3. Thereby, a click feeling is obtained. Coil spring 45 is pressed against the recess 44*a* within the hole 44. When the actuator 47 is rotated counterclockwise about the rotational shaft 48 by the spring force $F_2$, the arcwise projection 52 of the lower surface of the extended portion 49 of the actuator 47 causes the upper electrode 57 to be flexed downward as shown in FIG. 3 into contact with the lower electrode 58.

On the other hand, when the depression of the key top 42 is released, the key top 42 is moved upward by the force of the coil spring 45 from the FIG. 3 state. Then, the force of the coil spring 45 becomes weakened, and the force $F_2$ applied to the spring receiving projection 51 of the actuator 47 becomes small whereas the pressing force $F_1$ of the actuator 47 to the projection 53 caused by the side of the coil spring 45 becomes strong. Thereby, the actuator 47 is rotated clockwise about the rotational shaft 48 and reaches the inverted neutral point of the coil spring shown in FIG. 2. Then, the key top 42 is moved upward by the force of the coil spring 45, the coil spring 45 is inverted and curved rightward and the actuator 47 stops its rotation with the extended portion 50 thereof placed in contact with the side wall 41*a*. The key top 42 stops its upward movement with an engaging pawl 43*a* at the lower end of the sliding portion 43 enaged with an engaing portion 40*a* of the casing 40. In this way, the arcwise projection 52 of the actuator 47 is moved upward, and the upper electrode 57 having been flexed downwardly is returned to its original state by the elastic force, and the contact portion assumes an open state.

In the thus constructed embodiment, the projection 53 of the actuator 47 operated by the downward movement of the key top 42 presses the side of the coil spring 45 so as to invert the curved direction of the coil spring 45. Therefore, the curved orientation of the coil spring 45 is forcibly inverted by the projection 53, and the inverting operation of the coil spring 45, that is, the timing of the click operation is stabilized over a certain range of values of parameters of springs. Furthermore, for a given set of parameters, even if the length of the coil spring 45 is short, the click operation can be positively effected as compared with the prior art in which the coil spring is naturally buckled to produce a click feeling. Thereby, the push button switch can be made thinner, and material can be save to reduce the cost. In addition, the force of the actuator 47 in both rotational directions is applied by the single coil spring 45, and these forces are varied by the downward movement of the key top 42. Therefore, the supporting construction of the actuator 47 (the rotational shaft 48 is rotatably supported by the flat portion 56) becomes simple, and the switching operation is positively effected as well as stablization of timing of the click operation.

While in the above-described embodiment where the coil spring 45 has been described, it is to be noted that the present invention is not limited thereto but includes other spring members, for example, such as a plate spring.

With the above-described arrangement, the side of the spring is pressed by the click portion of the actuator through the downward movement of the key top, and therefore, the curved orientation of the spring is forcibly inverted by the click portion to stabilize the inverting operation of the spring, that is, timing of the click operation. Since the spring is forcibly inverted by the click portion, even if the length of the spring is short, the click operation can be effected positively.

As described above, according to the present invention, the side of the spring is pressed by the clip portion of the actuator operated by the downward movement of the key top so as to invert the curved direction of the spring. Therefore, the spring is forcibly inverted to stabilize timing of the click operation and improve an operating feeling. Moreover, since the spring is forcibly inverted, the overall length of the spring can be shortened to provide a compactness of apparatus.

What is claimed is:

1. A push button switch comprising:

a casing, a key top slidably insertable into said casing, a contact portion arranged below said key top, an actuator rotatably supported on said casing to open and close said contact portion by pressing said contact portion, a spring retained with curving in a first orientation between said actuator and said key top, characterized in that a click portion is provided on said actuator by which a transverse force is applied to an outside portion of said spring at or near a midpoint of said spring when said click portion of said actuator is actuated by downward movement of said key top so as to invert the first curved orientation of said spring.

2. A push button switch as in claim 1 wherein said transverse force is applied at a point above where said spring is retained by said actuator.

3. A push button switch as in claim 1 wherein said actuator is actuated by a moment produced by a force applied on an extended portion of said actuator by said spring.

4. A push button switch as in claim 1 wherein said actuator furtner comprises an extendeo portion to retain said spring in a line offset from an axis about which said actuator rotates.

5. A push button switch as in claim 1 wherein said actuator further comprises a rotational shaft by which said actuator is rotatably mounted to said casing.

* * * * *